US005123172A

United States Patent [19]

Thrun

[11] Patent Number: 5,123,172

[45] Date of Patent: Jun. 23, 1992

[54] SPACING GAUGE FOR MOLDING AND TRIM

[76] Inventor: Edward J. Thrun, 840 School Rd., Mosinee, Wis. 54455

[21] Appl. No.: 754,734

[22] Filed: Sep. 4, 1991

[51] Int. Cl.[5] ..... G01B 1/00; G01B 3/30

[52] U.S. Cl. ..... 33/526; 33/194; 269/905

[58] Field of Search ..... 33/194, 526; 269/904, 269/905

[56] References Cited

U.S. PATENT DOCUMENTS

| | | | |
|---|---|---|---|
| 1,599,025 | 9/1926 | Magnuson | 33/194 |
| 3,293,764 | 12/1966 | Born | 33/194 |
| 4,989,336 | 2/1991 | Waltrip, Jr. et al. | 33/526 |

FOREIGN PATENT DOCUMENTS

| | | | |
|---|---|---|---|
| 996346 | 9/1976 | Canada | 33/194 |

*Primary Examiner*—Thomas B. Will
*Attorney, Agent, or Firm*—Richard C. Litman

[57] ABSTRACT

A setback gauge for the marking and installation of molding and trim around structural framed openings provides a method of accurately marking the inner corner points of such molding and trim without the need for measurement, interpretation of measuring or other scales or adjustment of any tool or device. The gauge further provides an accurate and uniform edge setback distance when installing such trim. One embodiment includes a securing arm which allows the gauge to be temporarily installed in the frame without marring the frame in any way and thus allows the marking and installation of trim to be carried out by a single person without need to hold the gauge in place during use. An alternative embodiment provides a simpler gauge of monolithic form which is used just as the gauge of the first embodiment, but does not provide any method for retention in the frame.

7 Claims, 2 Drawing Sheets

SPACING GAUGE FOR MOLDING AND TRIM

FIELD OF THE INVENTION

This invention relates generally to tools and gauges used in the carpentry and cabinetry industries, and more specifically to a temporarily securable spacing gauge for determining the edge distance for molding and trim surrounding frames and openings.

BACKGROUND OF THE INVENTION

In the carpentry and cabinetry fields, it is standard practice in the construction of openings for windows, doors and the like to provide a "roughed in" opening in the basic structural framing. A prefabricated frame for the opening is then generally installed, with any extra space between the outer dimensions of the frame and the inner dimensions of the rough opening being adjusted with thin strips of material or shims.

When the adjacent interior walls are completed, either by gypsum wallboard ("DRYWALL"), plaster, or other material, there is often a relatively unsightly transition or slight gap between the edge of the finished wall and the frame of the opening. Typically, some form of molding or trim is used both to cover this area and also to provide some decorative transition between the installed frame of the opening and the adjacent wall.

Generally the inner edge of such trim is set back from the inner edge of the corresponding portion of the finished door frame. Obviously, it is highly desirable to provide a uniform spacing completely around the finished opening for this setback distance. Additionally, such molding or trim is almost universally provided with a mitered joint at adjoining corners, such as the corner joint between a vertical and an overlying horizontal trim piece. As it is highly desirable to provide a uniform edge distance completely around the opening, as noted above, the determination of the precise measurements for the finish cuts involved in fabricating and installing such trim or molding can become quite involved.

The need arises for an inexpensive, simple gauge for use in measuring and installing trim or molding for doors, windows and other similar openings, which gauge should be easy to use, usable by a single user, and accurate with a minimal amount of training. The gauge must provide at least some adjustment for possible varying widths of framed openings in order to be temporarily installed thereupon for use. It is also desirable that the gauge require a minimal number of steps in its use, and require no marking or defacing of the finished opening frame. Finally, the gauge should require a minimal amount of calculation in its use, thereby providing a savings in time and effort for the user.

DESCRIPTION OF THE RELATED ART

J. W. Erickson U.S. Pat. No. 2,473,639 discloses a door casing gauge which provides for some of the desirable features of the present invention; it is believed that this device is closest to the present invention of any of the known related art. However, the device of the Erickson patent must be held in place by the user while a mark or scribe line is placed upon the adjacent door frame, and/or the trim is aligned with the device for proper spacing. While the Erickson device provides for a considerable latitude of adjustment, this results in a relatively complex device which requires some skill and therefore time in setup, and which further allows for the possibility of error in setup. Moreover, the adjustment feature requires the use of an additional tool (a screwdriver) for adjustment. Accordingly, while the Erickson device functions differently, it provides no advance over the well known combination or framing square.

E. C. Sharrar U.S. Pat. No. 2,112,179 discloses a combination adjustable gauge and scribe which provides some limited use as a corner gauge for determining the position of the corner of a frame or trim member. The Sharrar device provides only for the marking of that corner position, rather than the additional desirable feature as an edge setback gauge.

J. R. Houts U.S. Pat. No. 1,787,313 discloses a hinge seat gauge for marking the appropriate cutout in door jambs and doors for the installation of hinges, particularly double acting hinges. As no provision is made for the alignment or installation of trim or molding components, it is felt that this patent has no bearing on the present invention.

Finally, S. J. Zangrando U.S. Pat. No. 2,144,697 discloses a tile cutting gauge. As in the patent to Houts above, no provision is made for use in laying out or installing trim or molding for the framing of openings, nor is any obvious modification of the device for such use seen. It appears, as in the case of the patent to Houts above, that the Zangrando device has no bearing upon the present invention.

None of the above noted patents, either singly or in combination, are seen to disclose the specific arrangement of concepts disclosed by the present invention.

SUMMARY OF THE INVENTION

By the present invention, an improved gauge for the determination of setback distances for edge molding and trim surrounding doors, windows and other similar openings in building structures is disclosed.

Accordingly, one of the objects of the present invention is to provide an improved gauge which is of monolithic construction.

Another of the objects of the present invention is to provide an improved gauge which may be constructed for a variety of edge setback distances.

Yet another of the objects of the present invention is to provide an improved gauge which may be temporarily self secured to an opening frame, thus allowing for use by a single person.

An additional object of the present invention is to provide an improved gauge Which does not require the marring or damaging of the frame in order to temporarily secure said improved gauge to said frame.

Still another of the objects of the present invention is to provide an improved gauge which is adjustable to varying widths of frame openings.

A further object of the present invention is to provide an improved gauge which does not require the use of additional tools for adjustment.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
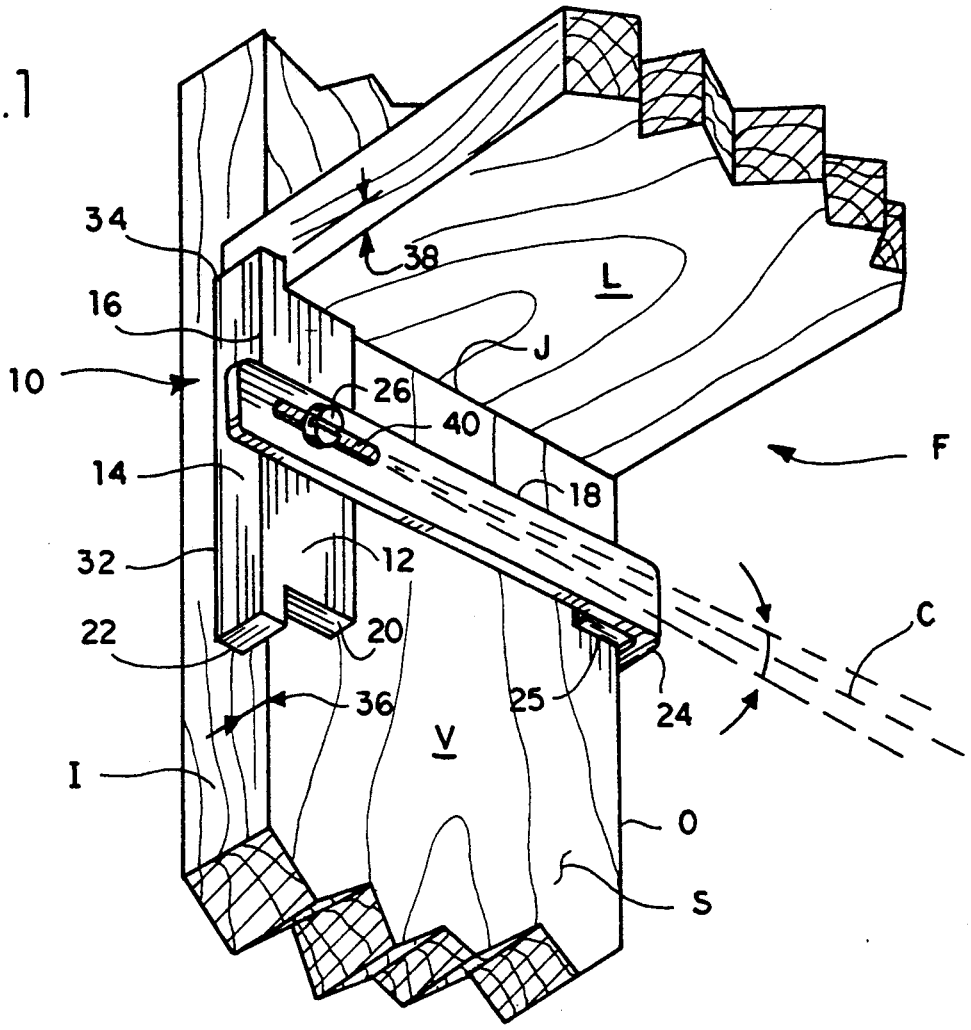
FIG. 1 is a perspective view of one embodiment of the present invention as it would be applied to a door frame for use.

Referring now to the drawings, particularly FIG. 1 of the drawings, the present invention will be seen to relate to a spacing gauge 10 for use in determining edge setback distances for molding and trim around the peripheries of doors, windows and the like in building construction. Gauge 10 is basically formed of a single component with two plates 12 and 14 extending from a common right angled edge 16. Gauge 10 may also be equipped with a securing arm 18, as shown in FIGS. 1 and 2.

FIG. 1 shows gauge 10 as it would be temporarily installed on a frame F in order to determine the proper edge setback for any molding or trim which may be installed. It will be apparent to those knowledgeable in the art that frame F could constitute a frame for a door, window or virtually any other opening in a building structure to which decorative molding, trim or the like might be applied. Such frames F generally have joints J interconnecting various members such as vertical member V and lintel L, with angles A of 90 degrees. It should be further apparent that gauge 10 may easily be made to accommodate angles A other than 90 degrees if the occasion should arise. In such a case, the modification need only comprise the provision of the proper matching angles to corner face 20 and corresponding spacing edge 22. It will be noted further that gauge 10 is symmetrical about center line C, and thus may be reversed for use with either inner edge I or outer edge O of frame F.

Figure 2:
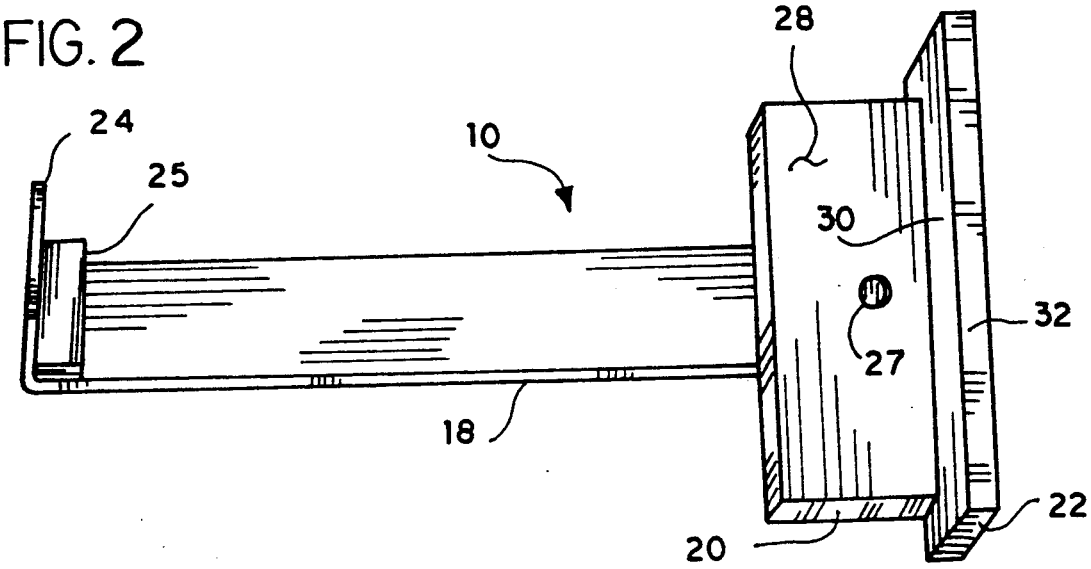
FIG. 2 is a perspective view of the reverse side of the invention.

Gauge 10 of FIGS. 1 and 2 provides further for temporary self securing to a frame F by means of extension arm 18. Arm 18 includes a distal catch 24 which in combination with the second surface 14 of gauge 10 serves to hold gauge 10 in place upon frame F. Distal catch 24 will be seen to extend from the distal end of arm 18 in the same direction as that of second plate 14, thus providing an included space between second plate 14 and distal catch 24.

Arm 18 is pivotally secured to first plate 12 by means of pivot 26. Pivot 26 is preferably in the form of a threaded fastener which mates with a threaded hole in first plate 12, but may comprise other suitable pivot means. It will be noted that the opposite end 27 of pivot 26 does not protrude from the inner surface 28 of first plate 12, thus allowing first plate inner surface 28 to be placed flush against the inner surface S of frame F as described below.

Gauge 10 may be secured to frame F by placing the inner surface 28 of first plate 12 against the inner surface S of vertical frame member V with the inner surface 30 of second plate 14 against the inner edge I of vertical frame member V, and sliding gauge 10 along vertical member V until one corner edge 20 of gauge 10 contacts the inner surface of lintel L. Gauge 10 may then be secured in place by swinging arm 18 either upward or downward about pivot 26, causing catch 24 to be simultaneously displaced slightly inward against the outer edge 0 of vertical member V due to the radial arc which distal catch 24 traverses as arm 18 is swung upward or downward. As distal catch 24 moves inward, it contacts and grips the outer edge O of frame vertical member V, thus frictionally holding gauge 10 in place on frame F between second plate inner surface 28 and distal catch 24 without any requirement for additional support or gripping means. A spacer 25 of the same thickness as first plate 12 is provided adjacent to catch 24 in order to maintain arm 18 in a parallel relationship to surface S of Vertical frame member V when gauge 10 is installed thereupon as described below, and thus obviate any tendency to bend arm 18.

When gauge 10 has been temporarily installed upon a frame F as described above, a vertical trim piece VT may be aligned with the inner edge I of vertical member V, with the lower end of vertical trim VT positioned as desired. This may be more clearly seen in FIG. 3. (It will be noted that the embodiment disclosed in FIG. 3 does not include securing arm 18. However, each of the other callouts and features described are identical between the embodiment of FIGS. 1 and 2 and the embodiment of FIG. 3.) The upper end of vertical trim VT may be placed against setback edge 32 of gauge 10, with the outer or setback corner 34 of gauge 10 establishing a point on the abutting vertical trim VT for the inner edge of the required diagonal cut at the proper location. It will be noted that setback corner 34 establishes the inner corner point for both vertical trim component VT and lintel trim component LT when gauge 10 is installed as described above.

Vertical trim VT may then be marked accordingly, removed and cut to length An important point to note is that no marks or indications need be placed upon any part of frame F when using gauge 10. The only marks required are those which designate the point at which trim components VT and LT must be cut, and such marks will of course be obliterated when the cut is made. As pencil and other marks are notoriously difficult to remove from unfinished wood surfaces, gauge 10 provides for a great labor savings over other methods of trim installation since it is not necessary to eradicate markings from any of the components.

Gauge 10 automatically provides further for the proper edge setback distance 38 for an adjacent horizontal or lintel trim component LT when installed as above. Typically, identical trim edge setback distances 36 and 38 are desired for the trim setback for both vertical trim VT and lintel trim LT components. Gauge 10 provides for this by means of spacing edge 22 which extends beyond corner edge 20 by a distance 38 which is equal to the setback distance 36 established by the extension of setback edge 32 beyond first plate 12. Lintel trim LT may be positioned abutting spacing edge 22 and thus establishing the proper lintel trim setback distance 38, and the appropriate point established by setback corner 34 may be marked on lintel trim LT in order to establish the inner point for the proper diagonal cut to mate with vertical trim component VT. when the various trim components VT and LT have been marked and cut as described above, gauge 10 may be removed and installed at the opposite upper corner of frame F in order to establish the length of the opposite vertical trim component, and may then be removed and reversed on frame F with gauge 10 positioned on the outer edge O of frame F in order to determine the proper lengths of those trim components which will be installed upon the outer edge O of frame F.

When each of the various trim components have been marked and cut, they may be easily and accurately installed by means of gauge 10. By positioning gauge 10 as described above, both vertical trim VT and lintel trim LT may be placed respectively abutting setback edge 32 and spacing edge 22 and secured in place. Proper spacing along the entire length of each trim component VT and LT may be established by removing and repositioning gauge 10 at various positions along frame F as necessary to establish an accurate and uniform setback distance 36 for each trim component.

Various modifications of the above described gauge 10 may be envisioned by those knowledgeable in the art. The modification required in order to permit such a trim gauge to be used with frames having joint angles other than 90 degrees was briefly described above. Another modification which might be desirable to some persons is a provision for unequal trim setback distances for vertical trim and lintel trim components. This may be achieved by providing a vertical setback edge distance which is greater or less than the lintel edge setback distance established by the lintel trim spacing edge of the gauge.

An additional desirable feature is a provision for the adjustability of the distance between the inner surface 30 of second plate 14 and distal catch 24. Typically, frames F are constructed in widths of 4½ inches, thus providing ½ inch additional thickness to either side of the standard "two by four" (actually 3½ inches in width) wall frame structure. The additional ½ inch to either side allows for the thickness of such wall finishing materials as lath and plaster, wallboard, etc. However, in some cases such walls may be constructed in a different thickness and therefore frame F must be of a different width. Gauge 10 provides for this variability by means of slot 40 which provides for the securing of arm 18 to first plate 12. By loosening fastener 26, the distance between the inner surface 30 of second plate 14 and distal catch 24 may be adjusted by sliding the slot 40 of arm 18 along pivot 26 to the desired location and tightening pivot 26 to secure arm 18 to first plate 12. No additional tools are required for this operation, as the act of loosening pivot 26 may be accomplished by turning arm 18 in a counterclockwise direction relative to first plate 12, thus permitting slot 40 and arm 18 to be repositioned as desired. When the desired position of arm 18 has been achieved, arm 18 may be turned clockwise and the frictional engagement between arm 18 and pivot 26 will serve to tighten pivot 26 in order to prevent the longitudinal movement of pivot 26 within slot 40. The lever arm provided by the length of arm 18 will still permit the relatively small angular displacement of arm 18 about pivot 26 and relative to first plate 12 in order to provide for the adjustment described above, and further to provide for the temporary securing of gauge 10 to a frame F as described above.

Figure 3:
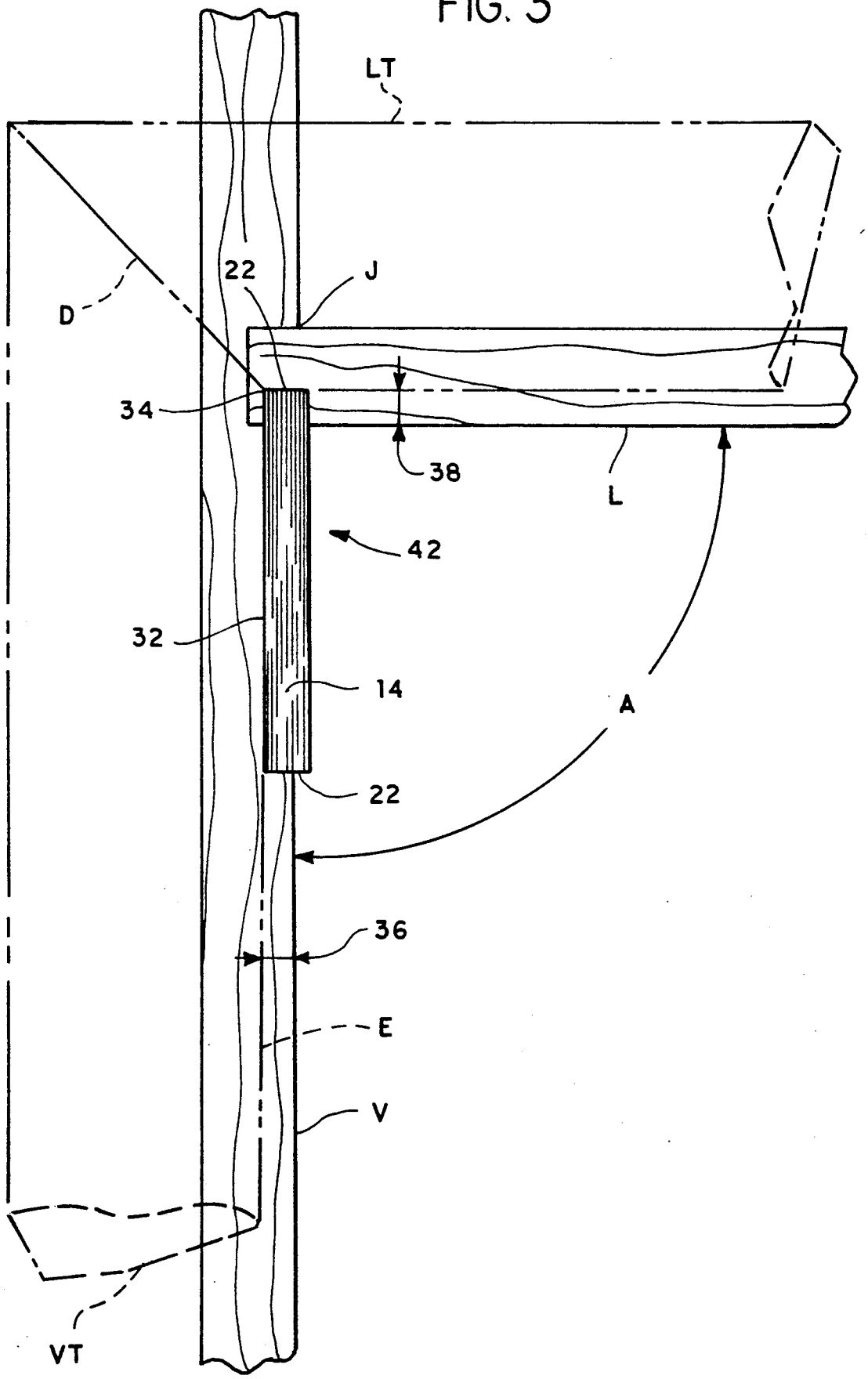
FIG. 3 is a side view of an alternative embodiment of the present invention showing its use as a trim spacing gauge.

An alternative embodiment 42 of gauge 10 is shown in FIG. 3, which figure additionally more clearly indicates the accompanying molding or trim T for which gauges 10 and 24 provide spacing. It will be apparent from the foregoing and the accompanying drawing figures that the portions of gauges 10 and 42 comprising first and second plates 12 and 14 are essentially identical, with the exception of any provision in first plate 12 for the attachment of a securing arm 18. Thus, while the embodiment of gauge 10 permits use by a single person, no means is provided in gauge 42 for securing to a frame F for use. Other means, such as a second party or mechanical or adhesive means holding gauge 42 in position for use, must be provided. Once gauge 42 is positioned upon frame F as desired, the function and use of gauge 42 is identical to that of gauge 10.

It is to be understood that the present invention is not limited to the sole embodiment described above, but encompasses any and all embodiments within the scope of the following claims.

I claim:

1. A gauge providing for the accurate marking of peripheral molding and trim prior to cutting said molding and trim for installing said molding and trim adjacent to the peripheral edges of a jointed framed opening in a structure, said gauge comprising;

a first plate and a second plate formed as a single unit, said first and said second plates each respectively having an inner and an outer surface and having an included angle of 90 degrees between said inner surfaces and a common edge therebetween, said first plate having two corner edges extending from said common edge, said second plate having a setback edge opposite said common edge and two spacing edges therebetween, at least one said spacing edge and said setback edge having a common corner defining a setback corner, a securing arm pivotally and frictionally attached to said first plate and arcuately pivotable in the same plane as said first plate, said securing arm having a distal end including a catch thereby defining an included space between said catch and said second plate, whereby said gauge is placed upon said framed opening with one said first plate corner edge abutting said frame joint and said gauge common edge positioned along said frame edge periphery with said setback corner defining an inner corner for said marking of said molding and trim, said gauge frictionally and removably held in position by means of said arcuately pivotable securing arm distal catch and said second plate gripping said frame in said space provided therebetween.

2. The gauge of claim 1 wherein;

said spacing edge and said setback edge define innermost edges for the positioning of said molding and trim for installation on said frame.

3. The gauge of claim 1 wherein;

said spacing edge and said setback edge form an angle of 90 degrees.

4. The gauge of claim 1 wherein;

said spacing edge and said setback edge each respectively define a trim setback distance, and said spacing edge trim setback distance and said setback edge trim setback distance are equal.

5. The gauge of claim 1 wherein;

each said spacing edge provides equal spacing edge trim setback distances.

6. The gauge of claim 1 including;

means providing adjustment of said space between said second plate and said catch.

7. The gauge of claim 1 including:

a spacer adjacent said catch and coplanar with said first plate, said spacer equal in thickness to said first plate and thereby providing for arcuate actuation of said securing arm in a plane parallel to that of said first plate.

* * * * *